United States Patent [19]

Blomstedt

[11] 4,016,700

[45] Apr. 12, 1977

[54] STRUCTURAL SHEET METAL BAR MEMBER FOR USE IN HEAT INSULATING BUILDING PARTS

[75] Inventor: Hans Carl Magnus Blomstedt, Stockholm, Sweden

[73] Assignee: Interoc Fasad Aktiebolag, Koping, Sweden

[22] Filed: Oct. 9, 1975

[21] Appl. No.: 621,059

[30] Foreign Application Priority Data

Oct. 16, 1974 Sweden ..... 7413045

[52] U.S. Cl. ..... 52/735; 52/481; 52/732

[51] Int. Cl.[2] ..... E04C 3/09

[58] Field of Search ..... 52/634, 636, 720, 729, 52/732, 735, 673, 406, 674, 404, 481, 675

[56] References Cited

UNITED STATES PATENTS

| | | | |
|---|---|---|---|
| 681,355 | 8/1901 | Turnbull | 52/675 |
| 782,667 | 2/1905 | Kuhne | 52/675 X |
| 930,255 | 8/1909 | Wilson | 52/674 X |
| 1,077,404 | 11/1913 | Goldsmith | 52/674 X |
| 2,605,867 | 8/1952 | Goodwin | 52/729 X |
| 2,924,856 | 2/1960 | Price | 52/483 X |
| 3,129,792 | 4/1964 | Gwynne | 52/720 X |
| 3,381,439 | 5/1968 | Thulin, Jr. | 52/729 |
| 3,841,047 | 10/1974 | Zinn | 52/732 X |
| 3,950,912 | 4/1976 | Lundberg et al. | 52/404 X |

*Primary Examiner*—Leslie Braun
*Attorney, Agent, or Firm*—Eric Y. Munson

[57] ABSTRACT

A sheet metal bar member for use as a distance-keeping, stiffening and load-supporting structural framing element in heat insulating building parts of the general class comprising two panels held together in spaced relationship by a framing and having the interspace between them at least partially filled with a heat insulating material, said structural bar member having, between a pair of flanges serving as attachments for the panels, a web that is perforated by a great number of staggered slits arranged in at least four laterally spaced longitudinal rows, said bar member featuring slits bordered by stiffening edge portions bent out approximately at right angle from the plane of the web and additional stiffening formations between adjacent slit ends and adjacent slit rows to permit a minimizing of the thickness of the sheet metal used in the web of the bar member and, hence, also a minimizing of the heat conductivity of said web in the direction from flange to flange of the bar member for a given structural strength required.

7 Claims, 6 Drawing Figures

STRUCTURAL SHEET METAL BAR MEMBER FOR USE IN HEAT INSULATING BUILDING PARTS

Figure 1:
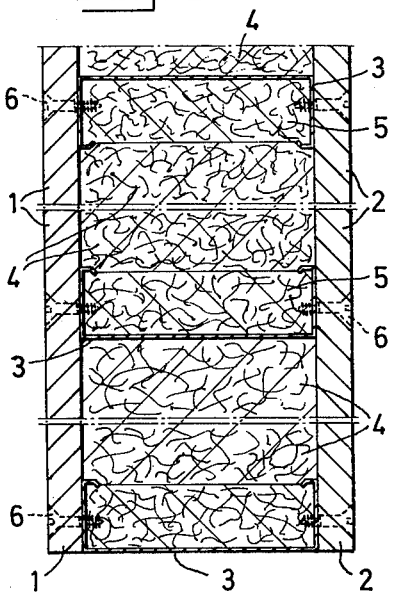

This invention relates to a sheet metal bar member for use as a distance-keeping, stiffening and load-supporting structural element in heat insulating building parts of the general class comprising two panels held together in spaced relationship by a framing composed of such elements and having the interspace between them at least partially filled with a heat insulating material. More specifically the invention is concerned with a structural sheet metal bar member for such applications comprising a pair of flange portions serving as attachments for the panels, and between them an integral web portion that is perforated by a great number of open slits extending in the longitudinal direction of the bar and arranged in a plurality of laterally spaced longitudinal rows, the distance between adjacent ends of the slits in each slit row being less than half the slit length, which is at least generally the same for all the slits, and the slits in adjacent rows being staggered and overlapping each other with a part of their length corresponding to at least the distance between the most adjacent edges of the slits in the two slit rows in question. Thereby an extended tortuous path for the conduction of heat is formed between the two flange portions of the bar member.

For a long time it has been known to use various types of sheet metal bar members of the kind defined as a substitute for timbers in the construction of framings for heat insulating building parts of the class referred to hereinbefore and, particularly, in the construction of prefabricated wall elements. However, no such structural sheet metal bar member of any type or design so far known has ever been quite satisfactory and capable of competing successfully with timber of corresponding dimensions in all respects. The difficulty still not overcome in spite of years of efforts is to provide a structural sheet metal bar member of the kind in question that combines with a minimum of heat conductivity in the direction between its two flange portions the greatest possible web stiffness at the smallest possible material consumption and weight. It is to be understood that the latter factors are highly important because, when rational methods are applied in the production of such bars, the cost of the basic sheet metal material will amount to as much as 80% or more of the total factory cost.

The object of the present invention is, therefore, to provide an improved structural sheet metal bar member of the kind defined hereinbefore that can be produced from a surprisingly thin sheet metal material but will still be able to meet all requirements for structural strength reasonably to be expected within the field of application referred to hereinbefore. This means that the improved structural sheet metal bar member according to the invention will not only compare with but become entirely superior to framing timber, because it already inherently possesses a better dimensional stability under varying moisture conditions, including no tendency to warp, and a substantially higher durability, provided that its material is properly chosen or has been properly treated to withstand corrosive attacks.

Evidently, in a structural sheet metal bar member of the kind here in question the provision of the great number of slits in the web portion thereof involves in itself a substantial weakening of the bar, or, more specifically, a considerable reduction of its resistance to bending. This weakening cannot be compensated by increasing the thickness of the sheet metal, because such an increase would result not only in a corresponding increase of the heat conductivity of the web portion but also in an objectionable increase of the material consumption and the total production costs. Accordingly, the aim of the present invention is, basically, to find an effective solution of the problem, how to otherwise compensate said weakening of the bar member in order to thereby permit, on one hand, the provision of a considerable number of slit rows in the web portion thereof and, on the other hand and at the same time, a considerable decrease of the sheet metal thickness as compared with the one hitherto needed in bars having similar overall dimensions and equivalent structural properties within the limits actually required for its practical application.

In accordance with the invention this is achieved primarily by the combined features that the slits along both their longitudinal sides are bordered by edge portions bent out at least approximately at right angle from the plane of the web portion and projecting to a height over the surrounding surface of the web portion corresponding to at least twice the sheet metal thickness, and that between adjacent ends of the slits in each slit row there are provided stiffening formations in the sheet metal forming the web portion. The rigidizing effect of this is highly remarkable and surprising. Nevertheless further improvements may be achieved by adding further secondary features as will appear from the following.

In order to avoid possible misunderstandings, it should be pointed out already here that, although the configuration and size of the flange portions of the bar member may be important from other points of view, it is entirely irrelevant to the invention, which solely deals with the problem of satisfactory rigidizing the web portion proper of the bar. Consequently, the invention is applicable not only to bars having a generally U-shaped cross section but also to bars having a generally Z-, I- or H-shaped cross section and even to composite bars of combined such sections, for instance boxbeam-bars having two or more spaces web portions.

For elucidation of the invention a diagrammatic example of the field of application of a bar member embodying the same as well as two preferred forms of the bar member itself will now be described with reference to the accompanying drawings, in which FIG. 1 is a considerably shortened section through a heat insulating building part including a framing constructed from structural sheet metal bar members according to the invention, the section shown being either a horizontal section or a vertical section, as desired.

Figure 4:
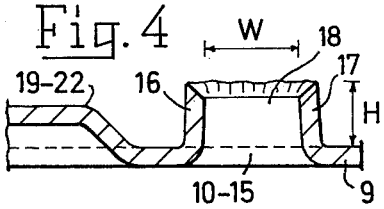
Figure 3:
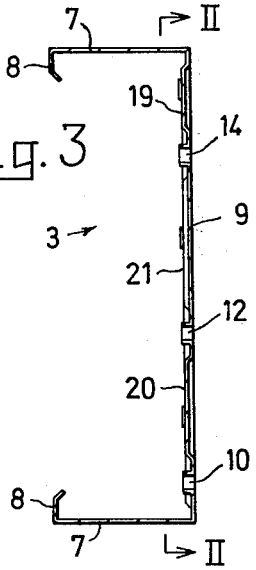
Figure 2:
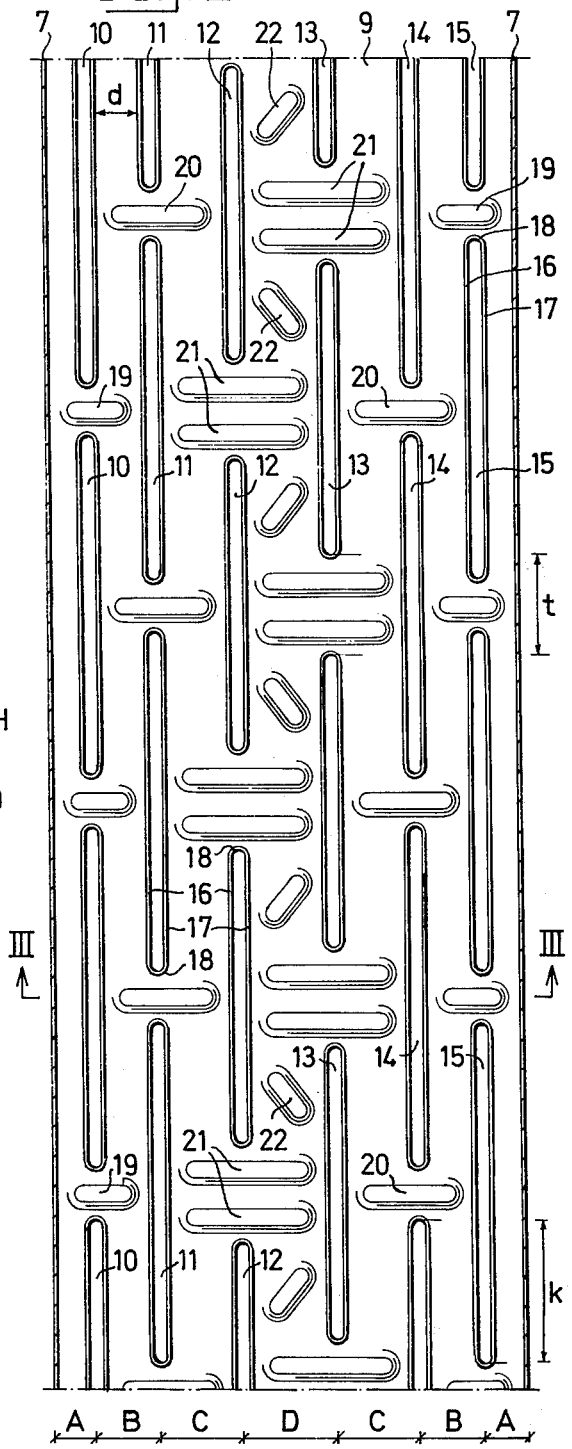
Figure 5:
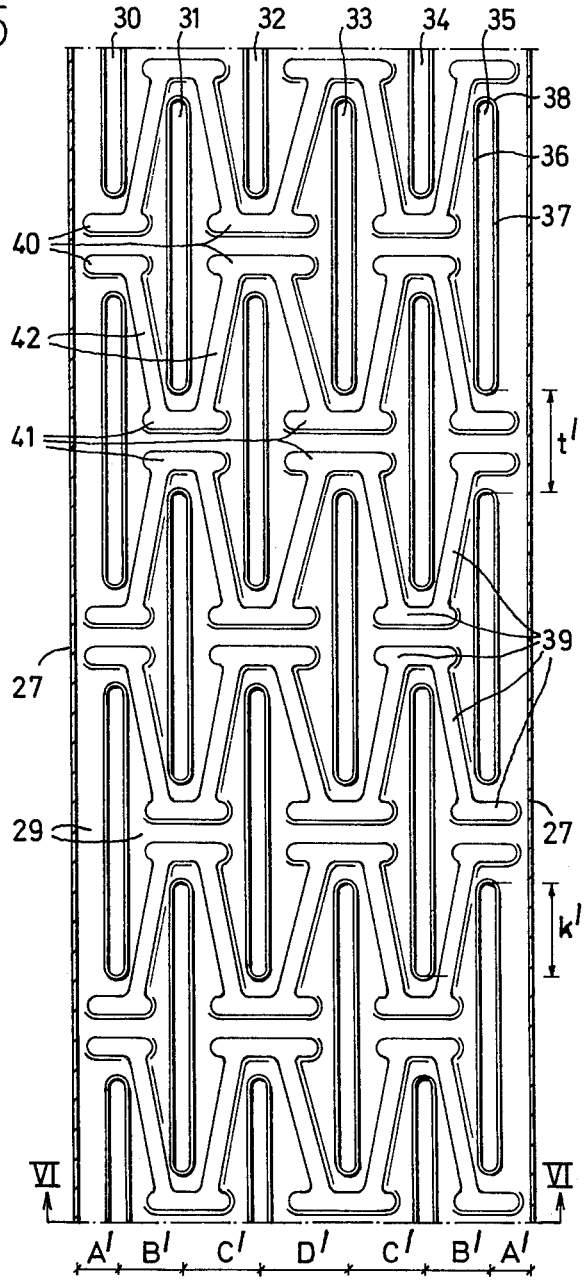
Figure 6:
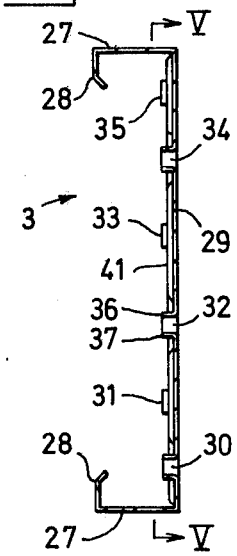

FIG. 2 is a plan view on a considerably larger scale of the web portion of a first form of the sheet metal bar member embodying the invention, the flange portions of the bar being removed for the sake of a better clearance so that the figure in fact represents a partial view as seen from the line II—II in FIG. 3, FIG. 3 is a sectional elevation as seen from the line III—III in FIG. 2, FIG. 4 is a fragmentary sectional elevation of the bar on a strongly enlarged scale, FIG. 5 is a plan view similar to that of FIG. 2 but showing the web portion of a second form of the sheet metal bar member embodying the invention, the flange portions of the bar being also here partly removed, so that the figure in fact represents a view as seen from the line V—V in FIG. 6, and FIG. 6 is a sectional elevation of the bar member of FIG. 5 as seen from the line VI—VI therein.

The building part or wall element illustrated in FIG. 1 comprises two panels 1 and 2 held together in spaced relationship by means of distance-keeping, stiffening and load-supporting framing bars 3 of thin sheet metal, the interspace between them being filled with a heat insulating material, e.g. in the form of pads or strips 4 and 5 of mineral wool, some of which enter the cavities of the framing bars 3, which are channel-like and have opposite flange portions, to which the panels 1,2 are secured, such as by means of screws, as indicated at 6. In a structure of the kind illustrated in FIG. 1 it is extremely important to prevent the framing bars 3 from forming heat leaks in the thickness direction of the structure, i.e. in the direction between the panels 1 and 2 or vice versa, by showing a considerably higher heat conductivity than the structure sections between them. Apart from the fact that such heat leaks, where the heat transmission coefficient is considerably increased, are detrimental to the average heat insulating capacity of the structure as a whole, they are highly objectionable also because they give rise to a plurality of secondary problems well known to the man skilled in the building art.

Now, this is most successfully achieved by forming the web portion of the sheet metal framing bars 3 in a rather peculiar manner, as will appear from the following.

In FIG. 3 there is shown on an enlarged scale a cross sectional elevation of a first improved form of such a framing bar 3, this bar being formed by bending a thin sheet metal into a generally U- or channel shape having two parallel flange portions 7, the longitudinal outer and free marginal portions 8 of which are further bent for increased stiffness, said flange portions being held apart but firmly connected by a generally flat web portion 9. As best appears from FIG. 2, this web portion 9 is by punching and pressing operations formed in a manner, which, on one hand, forms a considerably extended path of heat conduction between the flange portions 7 and, on the other hand, effectively prevents weakening and stiffness reduction of the web portion 9 as a consequence of the firstmentioned measure.

The extended path of heat conduction is obtained by the fact that the web portion 9 is perforated by a great number of longitudinally extending slits 10,11,12,13,14 and 15 arranged in a plurality of laterally spaced longitudinal rows. The slits in adjacent rows are staggered so as to partly extend beyond or overlap each other by at least one third of their length, which slightly exceeds half the width of the web portion 9 but is less than the full width thereof. In the example illustrated the number of slit rows is six, but this number may be varied from a minimum number of four to a maximum number of twelve or more, whenever required.

In each row the distance $t$ between adjacent slit ends should be less than half the slit length, and is actually about one third thereof or less, and the overlap $k$ between the slits in adjacent rows should at least correspond to, and actually exceeds, the distance between the most adjacent edges of the slits in the two slit rows in question. In addition each slit in each row is located straightly opposite to a corresponding interspace between slit ends in the adjacent slit row. It should be clear that this arrangement of the slits results in a considerable extension of the path of heat conduction laterally through the web portion 9 between the flange portions 7 of the bar member and, consequently, in a considerable increase of the heat transmission coefficient for a given thickness of the sheet metal forming the same.

In order to compensate the weakening and stiffness reduction of the web portion of the bar which would normally result from the slitting described, the slits 10–15 are formed along both their longitudinal sides and, in fact, all around, i.e. along both their longitudinal sides as well as at their rounded ends, with edge portions 16,17,18 bent out at least approximately at right angle from the plane of the web portion 9 (see particularly FIG. 4), and projecting to a height H over the surrounding surface thereof corresponding at least to twice and preferably to about four times the thickness of the sheet metal forming the bar member. In the generally U-shaped bar shown, in which the flange portions 7 extend in the same direction from the web portion 9, the edge portions of the slits are bent out to project in the same direction as the flange portions. It should be understood that this bending out of the edge portions of each slit particularly along the two longitudinal sides thereof will result in a considerable stiffening of the slit edges and actually means that each narrow strip of the web portion extending longitudinally between two slits in adjacent slit rows will form a kind of small but surprisingly rigid U-beam all by itself.

Although a certain stretching of the sheet metal material can be expected in connection with the bending out of the edge portions of the slits, which is of course preceded by a cutting of the sheet metal, it will be necessary to make the open width W of the slits at least four times the sheet metal thickness. For manufacturing reasons the smallest distance $d$ between the bent out edge portions of the slits in two adjacent rows should be at least twice the open width of the slits. This, of course, limits the number of slit rows in a web portion 9 of a given width, but there will always be enough room for a sufficient number of slit rows because the sheet metal thickness needed for each width of the web portion is minimized.

In order to further improve the stiffness of the web portion of the bar it is contemplated to make the number of slit rows even and to distribute the slit rows uniformly or symmetrically on both sides of the longitudinally extending center line of the web portion, a slit row coinciding with said center line being, accordingly, avoided. Furthermore it has been found advantageous to let the lateral spacings B,C, and D, respectively, between adjacent slit rows increase towards the longitudinally extending center line of the web portion, and to make the distance A between each outer slit row and the adjacent flange portion 7 of the bar smaller than the spacing between the closest adjacent slit rows. By this arrangement the tendency of the web portion 9 to buckle under compressive forces acting in the plane thereof, and especially between the flange portions 7, is reduced.

A further and very important stiffening of the web portion of the profile bar in order to make it successfully resist any web buckling forces is achieved by the provision between adjacent ends of the slits 10–15 in the slit rows of elongate stiffening formations 19,20 and 21 extending transversally to and across the slits, i.e. in the direction of width of the web portion 9, and almost up to adjacent slit rows. These stiffening formations are doubled, i.e. arranged in pairs, whereever there is room enough for this, which is true, for instance, as far as the formations 21 are concerned, such a doubling being particularly valuable in the vicinity of the longitudinally extending center line of the web portion. The middlemost section of the web portion also has oblique stiffening formations 22 therein. In the present case all the stiffening formations 19–22 are generally trough-like embossments, where the sheet metal has been pressed out of the plane of the web portion 9. However, the embossments 19–21 may be replaced by slit-like apertures bordered by bent out edge portions and thus resembling the longitudinal slits 10–15 but extending in the transverse direction. Irrespective of whether the stiffening formations are embossments or slits having stiffened borders they are made to project in the same direction as the flange portions of the bar member, whereby the back of the web portion will remain substantially flat.

The second form of the improved bar member 3 shown in FIGS. 5 and 6 is likewise formed by bending a thin sheet metal into channel shape with two parallel flange portions 27 having their longitudinal outer and free marginal portions 28 further bent for increased stiffness. A generally flat web portion 29 extending between the flange portions has been subjected to punching and pressing operations to offer an extended path of heat conduction in its lateral direction without loosing its rigidity. Like in the first example the web portion 29 is perforated by a great number of longitudinally extending slits 30,31,32,33,34, and 35 arranged in a plurality of laterally spaced longitudinal rows, and the slits in adjacent rows are staggered to partly overlap each other by about one third of their length, which in turn is between one half and the full width of the web portion 29. The number of slit rows is shown to be six, but this number may, just as in the previous example, vary from four and upwards. In FIG. 5 all the slits are of the same length, but also in this case the spacings between the slit rows increases towards the centre line of the web portion from the respective flange portions 27. The distance with which the slits overlap each other in adjacent slit rows is throughout about equal to the spacing between the two middlemost slit rows.

In order to compensate for the weakening and stiffness reduction of the web portion 29, which would normally result from the slitting, all the slits 30–35 are along both their longitudinal sides and also at their rounded ends bordered by edge portions 36,37, and 38 bent out approximately at right angle from the plane of the web portion 29, and said edge portions project to a height over the surrounding surface of the web portion corresponding at least to twice the thickness of the sheet metal of the web portion. On the other hand the stiffening formations 39 are here continuous trough-like embossments running in a zigzag-like fashion in the transverse direction of the web portion 29 and including a plurality of transverse portions 40 and 41 of such a length that they almost extend up to the adjacent slit rows or the adjacent flange portion 27, as the case may be. The embossments 39 also include oblique portions 42 extending mainly in the longitudinal direction of the bar and interconnecting the transverse embossment portions 40 and 41. Stiffening formations of this particular configuration have been found to give a vary favorable stiffening effect which is still more striking than the one achieved in the example of FIGS. 2 and 3, and this is believed to be a result of the extended oblique embossment portions 42.

It should be understood that the forms of the improved structural bar member here shown and described for illustrative purposes may be subject to many modifications in particular as far as its size and the number of slit rows is concerned, when the bar member has to be adapted to meet a certain practical demand. However, in each form it will be possible to use a minimum sheet metal thickness in the production of the bar member thanks to the features suggested by the invention.

I claim:

1. A sheet metal bar member for use as a distancekeeping, stiffening and load-supporting structural framing element in heat insulating building parts of the general class comprising two panels held together in spaced relationship by a framing and having the interspace between them at least partially filled with a heat insulating material, said bar member comprising a pair of flange portions paralleling and serving as attachments for said panels and an integral web between said flange portions, the plane of said web being substantially at right angles to the planes of the panels, said web portion being perforated by open slits extending in the longitudinal direction of said bar member, said slits being arranged in at least four laterally spaced longitudinal rows, the distance between adjacent ends of said slits in each said slit row being at most one half of the slit length, and said slits in adjacent rows being staggered and overlapping each other with a part of their length corresponding to at least the distance between the most adjacent edges of the slits in the two slit rows in question, wherein each of said slits is bordered at least along both its longitudinal sides by edge portions bent out approximately at right angle from the plane of the web portion and projecting to a height over the surrounding web surface corresponding to several times the sheet metal thickness, wherein first elongate through-like embossments are pressed out of the plane of the web portion to extend transversely between adjacent slit ends in each slit row, said first embossments being doubled between the slit ends in at least some of the slit rows and each having a sufficient length in the direction of width of the web portion to extend almost up to the adjacent slit row on either side of the slit row in question, and wherein second elongate trough-like embossments are pressed out of the plane of the web portion to extend at a slightly oblique angle to the longitudinal direction of the bar member between at least two of the slit rows of the web portion, whereby said web portion is stiffened with reduced thickness of the sheet metal needed for forming the bar member and heat transfer across said web between said flange is reduced.

2. A structural bar member as claimed in claim 1 wherein said first, transversely extending embossments are doubled between the slit ends in all the slit rows.

3. A structural bar member as claimed in claim 1 wherein said second, obliquely extending embossments are provided between all pairs of adjacent slit rows.

4. A structural bar member as claimed in claim 1 wherein the length of the slits corresponds to at least half the width and at most the entire width of the web portion.

5. A structural bar member as claimed in claim 1 wherein the open width of the slits is about eight times the sheet metal thickness.

6. A structural bar member as claimed in claim 1 wherein the ends of said second embossments merge into said first embossments to form with them continuous zigzaging embossment lines extending from the vicinity of one flange portion of the bar member to the vicinity of the other flange portion thereof generally across the slitted web portion.

7. A sheet metal bar member for use as a distancekeeping, stiffening and load-supporting structural framing element in heat insulating building parts of the general class comprising two panels held together in spaced relationship by a framing and having the interspace between them at least partially filled with a heat insulating material, said bar member comprising a pair of flange portions serving as attachments for the panels and between them an integral web portion that is perforated by a great number of open slits extending in the longitudinal direction of the bar member and arranged in at least four laterally spaced longitudinal rows, each slit having a length corresponding to at least half and at most the entire width of the web portion and having also an open width corresponding to about eight times the sheet metal thickness of the web portion, the distance between adjacent ends of the slits in each slit row being at most one third of the slit length, and the slits in adjacent rows being staggered and overlapping each other with a part of their length corresponding to at least the distance between the most adjacent edges of the slits in the two slit rows in question, each of said slits being bordered at least along both its longitudinal sides by edge portions bent out approximately at right angle from the plane of the web portion and projecting to a height over the surrounding surface of the web portion corresponding to at least twice the sheet metal thickness, first elongate trough-like embossments being pressed out of the plane of the web portion in the same direction as are said slit edge portions bent out, said first embossments extending transversely between adjacent slit ends in each slit row and having a sufficient length in the direction of width of the web portion to extend almost up to the adjacent slit row on either side of the slit row in question, second elongate trough-like embossments being pressed out of the plane of the web portion in the same direction as are said slit edge portions bent out, said second embossments extending at a slightly oblique angle to the longitudinal direction of the bar member between at least two of the slit rows of the web portion, the ends of said second embossments merging into said first embossments to form with them continuous zigzaging embossment lines extending from the vicinity of one flange portion of the bar member to the vicinity of the other flange portion thereof generally across the slitted web portion.

* * * * *